US007210989B2

(12) United States Patent
Joslyn

(10) Patent No.: US 7,210,989 B2
(45) Date of Patent: May 1, 2007

(54) PLANARIZING MACHINES AND METHODS FOR DISPENSING PLANARIZING SOLUTIONS IN THE PROCESSING OF MICROELECTRONIC WORKPIECES

(75) Inventor: Michael J. Joslyn, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/828,403

(22) Filed: Apr. 20, 2004

(65) Prior Publication Data

US 2004/0198184 A1 Oct. 7, 2004

Related U.S. Application Data

(62) Division of application No. 09/939,430, filed on Aug. 24, 2001, now Pat. No. 6,722,943.

(51) Int. Cl.
*B24B 1/00* (2006.01)
*B24B 7/00* (2006.01)
*B24B 29/02* (2006.01)

(52) U.S. Cl. ..... 451/60; 451/287

(58) Field of Classification Search ..... 451/60, 451/285–289, 446

See application file for complete search history.

(56) References Cited

U.S. PATENT DOCUMENTS 4,530,463 A 7/1985 Hiniker et al.
5,020,283 A 6/1991 Tuttle
5,069,002 A 12/1991 Sandhu et al.
5,081,796 A 1/1992 Schultz
5,177,908 A 1/1993 Tuttle
5,209,816 A 5/1993 Yu et al.
5,225,034 A 7/1993 Yu et al.
5,232,875 A 8/1993 Tuttle et al.
5,234,867 A 8/1993 Schultz et al.
5,240,552 A 8/1993 Yu et al.

(Continued)

FOREIGN PATENT DOCUMENTS

JP 3-225921 A 10/1991

(Continued)

OTHER PUBLICATIONS

Kondo, S. et al., "Abrasive-Free Polishing for Copper Damascene Interconnection," Journal of the Electrochemical Society, vol. 147, No. 10, pp. 3907-3913, 2000, The Electrochemical Society, Inc.

*Primary Examiner*—M. Rachuba
(74) *Attorney, Agent, or Firm*—Perkins Coie LLP

(57) ABSTRACT

Machines with solution dispensers and methods of using such machines for chemical-mechanical planarization and/or electrochemical-mechanical planarization/deposition of microelectronic workpieces. One embodiment of such a machine includes a table having a support surface, a processing pad on the support surface, and a carrier assembly having a head configured to hold a microelectronic workpiece. The carrier assembly can further include a drive assembly that manipulates the head. The machine can also include a solution dispenser separate from the head. The solution dispenser can include a support extending over the pad and a fluid discharge unit or distributor carried by the support. The fluid discharge unit is configured to discharge a planarizing solution onto a plurality of separate locations across the pad.

19 Claims, 10 Drawing Sheets

U.S. PATENT DOCUMENTS

| | | | | |
|---|---|---|---|---|
| 5,244,534 | A | | 9/1993 | Yu et al. |
| 5,245,790 | A | | 9/1993 | Jerbic |
| 5,245,796 | A | | 9/1993 | Miller et al. |
| RE34,425 | E | | 11/1993 | Schultz |
| 5,297,364 | A | | 3/1994 | Tuttle |
| 5,354,490 | A | | 10/1994 | Yu et al. |
| 5,421,769 | A | | 6/1995 | Schultz et al. |
| 5,433,651 | A | | 7/1995 | Lustig et al. |
| 5,449,314 | A | | 9/1995 | Meikle et al. |
| 5,456,627 | A | | 10/1995 | Jackson et al. |
| 5,486,129 | A | | 1/1996 | Sandhu et al. |
| 5,514,245 | A | | 5/1996 | Doan et al. |
| 5,531,635 | A | | 7/1996 | Mogi et al. |
| 5,533,924 | A | | 7/1996 | Stroupe et al. |
| 5,540,810 | A | | 7/1996 | Sandhu et al. |
| 5,609,718 | A | | 3/1997 | Meikle |
| 5,616,069 | A | | 4/1997 | Walker et al. |
| 5,618,381 | A | | 4/1997 | Doan et al. |
| 5,618,447 | A | | 4/1997 | Sandhu |
| 5,624,303 | A | | 4/1997 | Robinson |
| 5,643,060 | A | | 7/1997 | Sandhu et al. |
| 5,645,682 | A | * | 7/1997 | Skrovan ..... 438/692 |
| 5,655,951 | A | | 8/1997 | Meikle et al. |
| 5,658,183 | A | | 8/1997 | Sandhu et al. |
| 5,658,190 | A | | 8/1997 | Wright et al. |
| 5,664,988 | A | | 9/1997 | Stroupe et al. |
| 5,664,990 | A | * | 9/1997 | Adams et al. ..... 451/60 |
| 5,679,063 | A | | 10/1997 | Kimura et al. |
| 5,679,065 | A | | 10/1997 | Henderson |
| 5,690,540 | A | | 11/1997 | Elliott et al. |
| 5,700,180 | A | | 12/1997 | Sandhu et al. |
| 5,702,292 | A | | 12/1997 | Brunelli et al. |
| 5,725,417 | A | | 3/1998 | Robinson |
| 5,730,642 | A | | 3/1998 | Sandhu et al. |
| 5,733,176 | A | | 3/1998 | Robinson et al. |
| 5,736,427 | A | | 4/1998 | Henderson |
| 5,738,567 | A | | 4/1998 | Manzonie et al. |
| 5,747,386 | A | | 5/1998 | Moore |
| 5,779,522 | A | | 7/1998 | Walker et al. |
| 5,782,675 | A | | 7/1998 | Southwick |
| 5,792,709 | A | | 8/1998 | Robinson et al. |
| 5,795,218 | A | | 8/1998 | Doan et al. |
| 5,795,495 | A | | 8/1998 | Meikle |
| 5,801,066 | A | | 9/1998 | Meikle |
| 5,807,165 | A | | 9/1998 | Uzoh et al. |
| 5,823,855 | A | | 10/1998 | Robinson |
| 5,827,781 | A | | 10/1998 | Skrovan et al. |
| 5,830,806 | A | | 11/1998 | Hudson et al. |
| 5,833,519 | A | | 11/1998 | Moore |
| 5,842,909 | A | | 12/1998 | Sandhu et al. |
| 5,846,336 | A | | 12/1998 | Skrovan |
| 5,851,135 | A | | 12/1998 | Sandhu et al. |
| 5,868,896 | A | | 2/1999 | Robinson et al. |
| 5,871,392 | A | | 2/1999 | Meikle et al. |
| 5,879,222 | A | | 3/1999 | Robinson |
| 5,879,226 | A | | 3/1999 | Robinson |
| 5,882,248 | A | | 3/1999 | Wright et al. |
| 5,893,754 | A | | 4/1999 | Robinson et al. |
| 5,895,550 | A | | 4/1999 | Andreas |
| 5,910,043 | A | | 6/1999 | Manzonie et al. |
| 5,916,819 | A | | 6/1999 | Skrovan et al. |
| 5,919,082 | A | | 7/1999 | Walker et al. |
| 5,930,699 | A | | 7/1999 | Bhatia |
| 5,934,980 | A | | 8/1999 | Koos et al. |
| 5,938,801 | A | | 8/1999 | Robinson |
| 5,945,347 | A | | 8/1999 | Wright |
| 5,954,912 | A | | 9/1999 | Moore |
| 5,964,413 | A | | 10/1999 | Mok |
| 5,967,030 | A | | 10/1999 | Blalock |
| 5,972,792 | A | | 10/1999 | Hudson |
| 5,975,994 | A | | 11/1999 | Sandhu et al. |
| 5,976,000 | A | | 11/1999 | Hudson |
| 5,980,363 | A | | 11/1999 | Meikle et al. |
| 5,981,396 | A | | 11/1999 | Robinson et al. |
| 5,989,470 | A | | 11/1999 | Doan et al. |
| 5,990,012 | A | | 11/1999 | Robinson et al. |
| 5,994,224 | A | | 11/1999 | Sandhu et al. |
| 5,997,384 | A | | 12/1999 | Blalock |
| 5,997,392 | A | | 12/1999 | Chamberlin et al. |
| 6,004,196 | A | | 12/1999 | Doan et al. |
| 6,036,586 | A | | 3/2000 | Ward |
| 6,039,633 | A | | 3/2000 | Chopra |
| 6,040,245 | A | | 3/2000 | Sandhu et al. |
| 6,050,884 | A | | 4/2000 | Togawa et al. |
| 6,053,801 | A | | 4/2000 | Pinson et al. |
| 6,054,015 | A | | 4/2000 | Brunelli et al. |
| 6,060,395 | A | | 5/2000 | Skrovan et al. |
| 6,062,958 | A | | 5/2000 | Wright et al. |
| 6,066,030 | A | | 5/2000 | Uzoh |
| 6,074,286 | A | | 6/2000 | Ball |
| 6,077,785 | A | | 6/2000 | Andreas |
| 6,083,085 | A | | 7/2000 | Lankford |
| 6,090,475 | A | | 7/2000 | Robinson et al. |
| 6,099,393 | A | | 8/2000 | Katagiri et al. |
| 6,110,820 | A | | 8/2000 | Sandhu et al. |
| 6,116,988 | A | | 9/2000 | Ball |
| 6,120,354 | A | | 9/2000 | Koos et al. |
| 6,124,207 | A | | 9/2000 | Robinson et al. |
| 6,135,856 | A | | 10/2000 | Tjaden et al. |
| 6,136,043 | A | | 10/2000 | Robinson et al. |
| 6,136,218 | A | | 10/2000 | Skrovan et al. |
| 6,139,402 | A | | 10/2000 | Moore |
| 6,139,406 | A | | 10/2000 | Kennedy et al. |
| 6,143,123 | A | | 11/2000 | Robinson et al. |
| 6,143,155 | A | | 11/2000 | Adams et al. |
| 6,152,808 | A | | 11/2000 | Moore |
| 6,156,659 | A | * | 12/2000 | Roy ..... 438/692 |
| 6,176,763 | B1 | | 1/2001 | Kramer et al. |
| 6,176,992 | B1 | | 1/2001 | Talieh |
| 6,179,693 | B1 | | 1/2001 | Beardsley et al. |
| 6,180,525 | B1 | | 1/2001 | Morgan |
| 6,186,870 | B1 | | 2/2001 | Wright et al. |
| 6,187,681 | B1 | | 2/2001 | Moore |
| 6,191,037 | B1 | | 2/2001 | Robinson et al. |
| 6,193,588 | B1 | | 2/2001 | Carlson et al. |
| 6,196,899 | B1 | | 3/2001 | Chopra et al. |
| 6,200,901 | B1 | | 3/2001 | Hudson et al. |
| 6,203,404 | B1 | | 3/2001 | Joslyn et al. |
| 6,203,407 | B1 | | 3/2001 | Robinson |
| 6,203,413 | B1 | | 3/2001 | Skrovan |
| 6,206,754 | B1 | | 3/2001 | Moore |
| 6,206,756 | B1 | | 3/2001 | Chopra et al. |
| 6,206,757 | B1 | | 3/2001 | Custer et al. |
| 6,206,759 | B1 | | 3/2001 | Agarwal et al. |
| 6,210,257 | B1 | | 4/2001 | Carlson |
| 6,213,845 | B1 | | 4/2001 | Elledge |
| 6,218,316 | B1 | | 4/2001 | Marsh |
| 6,220,934 | B1 | | 4/2001 | Sharples et al. |
| 6,234,874 | B1 | | 4/2001 | Carlson |
| 6,224,466 | B1 | | 5/2001 | Walker et al. |
| 6,227,955 | B1 | | 5/2001 | Custer et al. |
| 6,234,877 | B1 | | 5/2001 | Koos et al. |
| 6,234,878 | B1 | | 5/2001 | Moore |
| 6,237,483 | B1 | | 5/2001 | Blalock |
| 6,238,270 | B1 | | 5/2001 | Robinson |
| 6,244,944 | B1 | | 6/2001 | Elledge |
| 6,250,994 | B1 | | 6/2001 | Chopra et al. |
| 6,251,785 | B1 | | 6/2001 | Wright |
| 6,254,460 | B1 | | 7/2001 | Walker et al. |
| 6,261,151 | B1 | | 7/2001 | Sandhu et al. |
| 6,261,163 | B1 | | 7/2001 | Walker et al. |
| 6,267,650 | B1 | | 7/2001 | Hembree |
| 6,271,139 | B1 | | 8/2001 | Alwan et al. |
| 6,273,786 | B1 | | 8/2001 | Chopra et al. |

6,273,796 B1 8/2001 Moore
6,273,800 B1 8/2001 Walker et al.
6,276,996 B1 8/2001 Chopra
6,277,015 B1 8/2001 Robinson et al.
6,280,299 B1 8/2001 Kennedy et al.
6,284,092 B1 9/2001 Manfredi
6,284,660 B1 9/2001 Doan
6,290,579 B1 9/2001 Walker et al.
6,296,557 B1 10/2001 Walker
6,300,247 B2 10/2001 Prabhu
6,306,008 B1 10/2001 Moore
6,306,012 B1 10/2001 Sabde
6,306,014 B1 10/2001 Walker et al.
6,306,768 B1 10/2001 Klein
6,309,282 B1 10/2001 Wright et al.
6,312,486 B1 11/2001 Sandhu et al.
6,312,558 B2 11/2001 Moore
6,313,038 B1 11/2001 Chopra et al.
6,325,702 B2 12/2001 Robinson
6,328,632 B1 12/2001 Chopra
6,331,135 B1 12/2001 Sabde et al.
6,331,136 B1 12/2001 Bass et al.
6,331,139 B2 12/2001 Walker et al.
6,331,488 B1 12/2001 Doan et al.
6,338,667 B2 1/2002 Sandhu et al.
6,338,669 B1 1/2002 Togawa et al.
6,350,180 B2 2/2002 Southwick
6,350,183 B2 2/2002 Manfredi
6,350,691 B1 2/2002 Lankford
6,352,466 B1 3/2002 Moore
6,352,470 B2 3/2002 Elledge
6,354,917 B1 3/2002 Ball
6,354,919 B2 3/2002 Chopra
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,400 B2 3/2002 Southwick
6,361,411 B1 3/2002 Chopra et al.
6,361,413 B1 3/2002 Skrovan
6,361,417 B2 3/2002 Walker et al.
6,361,832 B1 3/2002 Agarwal et al.
6,364,749 B1 4/2002 Walker
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,375,548 B1 4/2002 Andreas
6,376,381 B1 4/2002 Sabde
6,383,934 B1 5/2002 Sabde et al.
6,387,289 B1 5/2002 Wright
6,395,620 B1 5/2002 Pan et al.
6,398,627 B1 6/2002 Chiou et al.
6,402,884 B1 6/2002 Robinson et al.
6,409,586 B2 6/2002 Walker et al.
6,428,386 B1 8/2002 Bartlett
6,439,977 B1 8/2002 Quek
6,447,369 B1 9/2002 Moore
6,482,290 B1 11/2002 Cheng et al.
6,491,764 B2 12/2002 Mertens et al.
6,498,101 B1 12/2002 Wang
6,511,576 B2 1/2003 Klein
6,520,834 B1 2/2003 Marshall
6,533,893 B2 3/2003 Sabde et al.
6,547,640 B2 4/2003 Hofmann
6,548,407 B1 4/2003 Chopra et al.
6,551,174 B1 * 4/2003 Brown et al. ..... 451/41
6,568,408 B2 5/2003 Mertens et al.
6,579,799 B2 6/2003 Chopra et al.
6,592,443 B1 7/2003 Kramer et al.
6,609,947 B1 8/2003 Moore
6,623,329 B1 9/2003 Moore
6,633,084 B1 10/2003 Sandhu et al.
6,652,764 B1 11/2003 Blalock
6,666,749 B2 12/2003 Taylor
6,669,538 B2 12/2003 Li et al.
6,722,943 B2 4/2004 Joslyn
6,809,348 B1 10/2004 Suzuki et al.
6,878,232 B2 4/2005 Chen et al.
6,884,152 B2 4/2005 Ramarajan
6,939,210 B2 9/2005 Polyak et al.
2001/0018323 A1 8/2001 Mulroy et al.
2002/0022440 A1 2/2002 Kunugi
2002/0113039 A1 8/2002 Mok et al.
2003/0027505 A1 2/2003 Withers et al.
2003/0054651 A1 3/2003 Robinson et al.
2003/0096559 A1 5/2003 Marshall
2004/0087258 A1 5/2004 Kimura et al.
2004/0209548 A1 10/2004 Joslyn
2004/0209549 A1 10/2004 Joslyn
2005/0170761 A1 8/2005 Ramarajan

FOREIGN PATENT DOCUMENTS

JP 2000-249440 A 9/2000

* cited by examiner

PLANARIZING MACHINES AND METHODS FOR DISPENSING PLANARIZING SOLUTIONS IN THE PROCESSING OF MICROELECTRONIC WORKPIECES

This application is a divisional application of U.S. patent application Ser. No. 09/939,430, entitled "PLANARIZING MACHINES AND METHODS FOR DISPENSING PLANARIZING SOLUTIONS IN THE PROCESSING OF MICROELECTRONIC WORKPIECES," filed Aug. 24, 2001, now U.S. Pat. No. 6,722,943, issued Apr. 20, 2004; and is related to U.S. patent application Ser. No. 10/828,427, filed Apr. 20, 2004; and U.S. patent application Ser. No. 10/828,017, filed Apr. 20, 2004; all of which are herein incorporated by reference in their entireties.

TECHNICAL FIELD

The present invention relates to planarizing machines and methods for dispensing planarizing solutions onto a plurality of locations of a processing pad in the fabrication of microelectronic devices.

BACKGROUND

Mechanical and chemical-mechanical planarizing processes (collectively "CMP") remove material from the surface of semiconductor wafers, field emission displays, read/write heads or other microelectronic workpieces in the production of microelectronic devices and other products. FIG. 1 schematically illustrates a CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a workpiece 12 may be attached, or the workpiece 12 may be attached to a resilient pad 34 in the head 32. The head 32 may be a free-floating wafer carrier, or an actuator assembly 36 may be coupled to the head 32 to impart axial and/or rotational motion to the workpiece 12 (indicated by arrows H and I, respectively).

The planarizing pad 40 and a planarizing solution 44 on the pad 40 collectively define a planarizing medium that mechanically and/or chemically-mechanically removes material from the surface of the workpiece 12. The planarizing pad 40 can be a soft pad or a hard pad. The planarizing pad 40 can also be a fixed-abrasive planarizing pad in which abrasive particles are fixedly bonded to a suspension material. In fixed-abrasive applications, the planarizing solution 44 is typically a non-abrasive "clean solution" without abrasive particles. In other applications, the planarizing pad 40 can be a non-abrasive pad composed of a polymeric material (e.g., polyurethane), resin, felt or other suitable materials. The planarizing solutions 44 used with the non-abrasive planarizing pads are typically abrasive slurries with abrasive particles suspended in a liquid.

To planarize the workpiece 12 with the CMP machine 10, the carrier assembly 30 presses the workpiece 12 face-downward against the polishing medium. More specifically, the carrier assembly 30 generally presses the workpiece 12 against the planarizing liquid 44 on a planarizing surface 42 of the planarizing pad 40, and the platen 20 and/or the carrier assembly 30 move to rub the workpiece 12 against the planarizing surface 42. As the workpiece 12 rubs against the planarizing surface 42, material is removed from the face of the workpiece 12.

CMP processes should consistently and accurately produce a uniformly planar surface on the workpiece to enable precise fabrication of circuits and photo-patterns. During the construction of transistors, contacts, interconnects and other features, many workpieces develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a workpiece.

In the highly competitive semiconductor industry, it is also desirable to maximize the throughput of CMP processing by producing a planar surface on a workpiece as quickly as possible. The throughput of CMP processing is a function, at least in part, of the polishing rate of the planarizing cycle and the ability to accurately stop CMP processing at a desired endpoint. Therefore, it is generally desirable for CMP processes to provide (a) a desired polishing rate gradient across the face of a substrate to enhance the planarity of the finished surface, and (b) a reasonably consistent polishing rate during a planarizing cycle to enhance the accuracy of determining the endpoint of a planarizing cycle.

Conventional planarizing machines may not provide consistent polishing rates because of nonuniformities in (a) the distribution of the slurry across the processing pad, (b) the wear of the processing pad, and/or (c) the temperature of the processing pad. The distribution of the planarizing solution across the surface of the processing pad may not be uniform because conventional planarizing machines typically discharge the planarizing solution onto a single point at the center of the pad. This causes a thicker layer of planarizing solution to be at the center of the pad than at the perimeter, which may result in different polishing rates across the pad. Additionally, the nonuniform distribution of the planarizing solution may cause the center region of the pad to behave differently than the perimeter region because many low PH solutions used during planarizing cycles are similar to cleaning solutions for removing stains and waste matter from the pads when polishing metallic surfaces. Such low PH planarizing solutions dispersed locally accordingly may change the physical characteristics differently at the center of the pad than at the perimeter. The nonuniform distribution of planarizing solution also causes a nonuniform temperature distribution across the pad because the planarizing solution is typically at a different temperature than the processing pads. For example, when the planarizing solution is at a lower temperature than the pad, the temperature near the single dispensing point of the planarizing solution is typically lower than other areas of the processing pad.

One concern of manufacturing microelectronic workpieces is that the distribution of the planarizing solution can cause variances in the planarized surface of the workpieces. For example, an inconsistent distribution of planarizing solution between the workpiece and the pad can cause certain areas of the workpiece to planarize faster than other areas. Nonuniform pad wear and nonuniform temperature distributions across the processing pad can also cause inconsistent planarizing results that (a) reduce the planarity and uniformity of the planarized surface on the workpieces, and (b) reduce the accuracy of endpointing the planarizing cycles. Therefore, it would be desirable to develop more consistent planarizing procedures and machines to provide more accurate planarization of microelectronic workpieces.

SUMMARY OF THE INVENTION

The present invention describes machines with solution dispensers for use in chemical-mechanical planarization and/or electrochemical-mechanical planarization/deposition of microelectronic workpieces. One embodiment of such a machine includes a table having a support surface, a processing pad on the support surface, and a carrier assembly having a head configured to hold a microelectronic workpiece. The carrier assembly can further include a drive assembly that carries the head. The machine can also include a solution dispenser separate from the head. The solution dispenser can include a support extending over the pad and a fluid discharge unit or distributor carried by the support. The fluid discharge unit is configured to simultaneously discharge a planarizing solution onto a plurality of separate locations across the pad.

In one particular embodiment, the solution dispenser comprises an elongated support extending over the pad at a location spaced apart from a travel path of the head, a fluid passageway carried by the support through which the planarizing solution can flow, and a plurality of nozzles carried by the support. The nozzles are in fluid communication with the fluid passageway to create a plurality of flows of planarizing solution that are discharged onto separate locations across the processing pad. An alternate embodiment of a machine in accordance with the invention includes a solution dispenser comprising an elongated support extending over the pad at a location spaced apart from the travel path of the head, a fluid passageway carried by the support through which a planarizing solution can flow, and an elongated slot extending along at least a portion of the support. The elongated slot is in fluid communication with the fluid passageway to create an elongated flow of planarizing solution. Another alternative embodiment includes an elongated support having a channel extending along at least a portion of the support through which the planarizing solution can flow and a lip along at least a portion of the channel over which the planarizing solution can flow. The lip accordingly defines a weir for depositing an elongated flow of planarizing solution across a portion of the pad.

Other embodiments of solution dispensers for the planarizing machine comprise an elongated support extending over the pad at a location spaced apart from the travel path of the head, a fluid passageway carried by the support, a first fluid discharge unit, and a second fluid discharge unit. The elongated support of these embodiments can include a first section and a second section. The first fluid discharge unit can be carried at the first section of the support to discharge a first flow of the planarizing solution onto a first location of the pad. The second fluid discharge unit can be carried by the second section of the support to discharge a second flow of the planarizing solution onto a second location of the pad. The first and second fluid discharge units can be independently controllable from one another so that the first flow of planarizing solution discharged onto the first location of the pad is different than the second flow of planarizing solution discharged onto the second location of the pad.

DETAILED DESCRIPTION

The following disclosure describes planarizing machines with planarizing solution dispensers and methods for planarizing microelectronic workpieces. The microelectronic workpieces can be semiconductor wafers, field emission displays, read/write media, and many other workpieces that have microelectronic devices with miniature components (e.g., integrated circuits). Many of the details of the invention are described below with reference to rotary planarizing applications to provide a thorough understanding of such embodiments. The present invention, however, can also be practiced using web-format planarizing machines and electrochemical-mechanical planarizing/deposition machines. Suitable web-format planarizing machines that can be adapted for use with the present invention include U.S. patent application Ser. Nos. 09/595,727 and 09/565,639, which are herein incorporated by reference. A suitable electrochemical-mechanical planarizing/deposition machine that can be adapted for use is shown in U.S. Pat. No. 6,176,992, which is also herein incorporated by reference. A person skilled in the art will thus understand that the invention may have additional embodiments, or that the invention may be practiced without several of the details described below.

Figure 1:
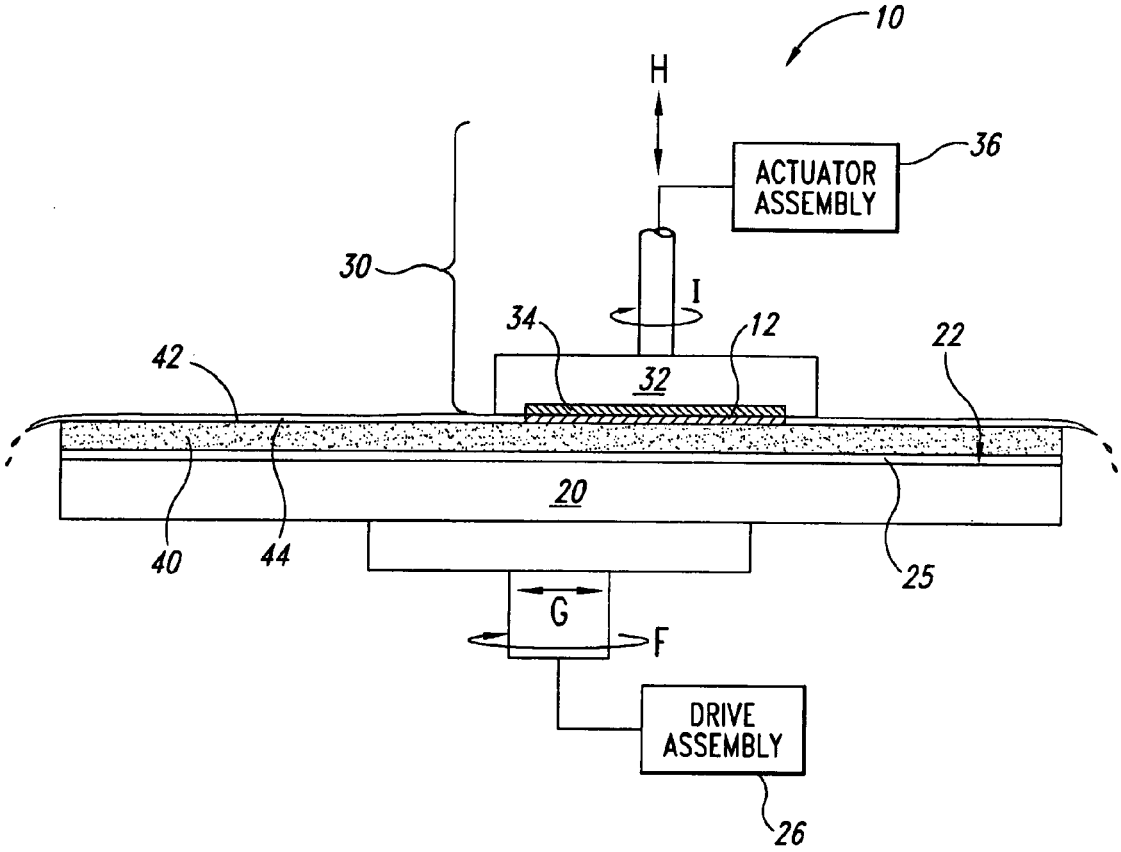
Fig. 1 (Prior Art)
FIG. 1 is a cross-sectional view of a planarizing machine in accordance with the prior art in which selected components are shown schematically.
Figure 2:
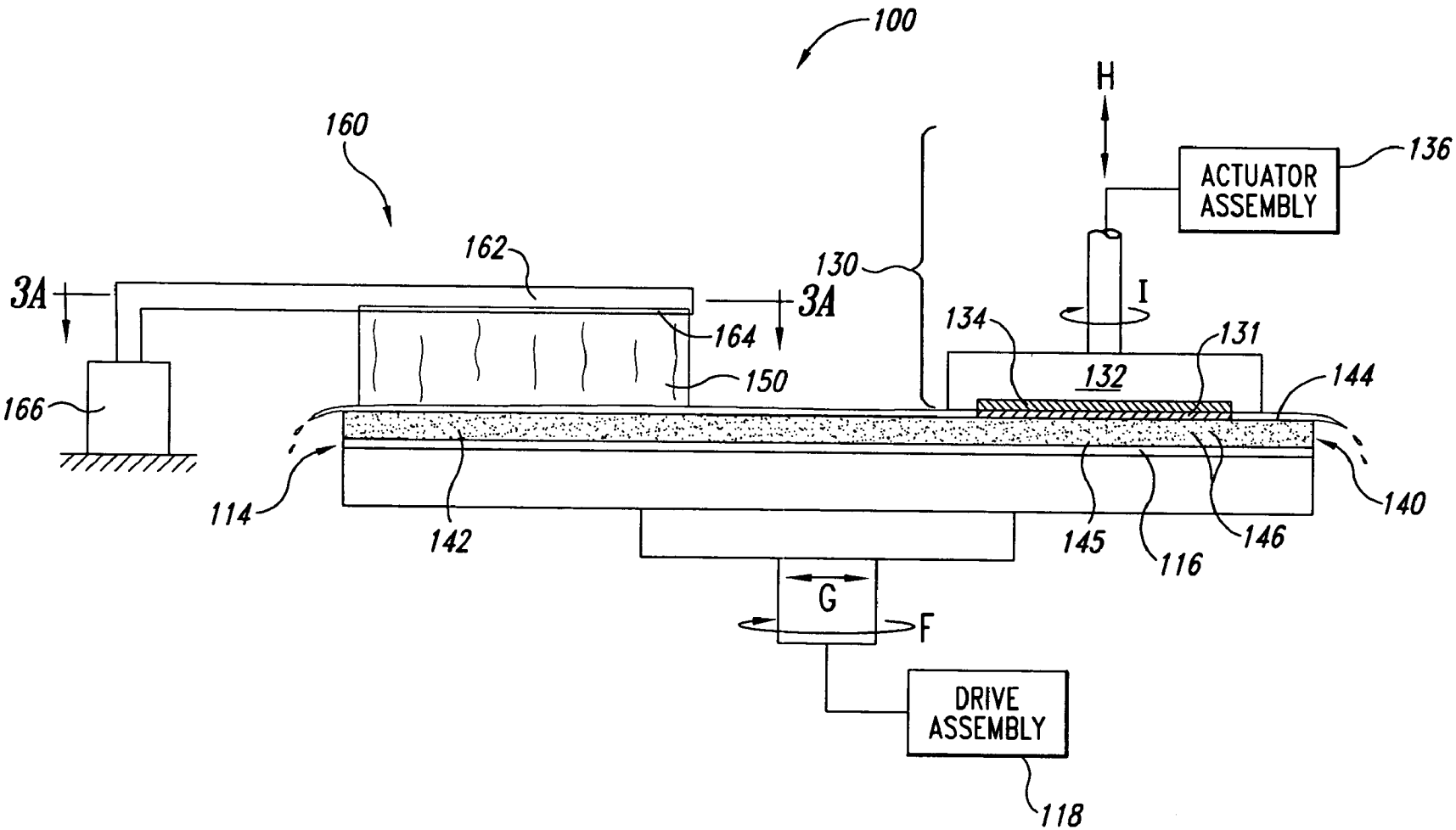
FIG. 2 is a side elevation view of a planarizing system including a planarizing solution dispenser in accordance with an embodiment of the invention with selected components shown in cross-section or schematically.

FIG. 2 is a cross-sectional view of a planarizing system 100 having a planarizing solution dispenser 160 that discharges a planarizing solution 150 in accordance with an embodiment of the invention. The planarizing machine 100 has a table 114 with a top panel 116. The top panel 116 is generally a rigid plate to provide a flat, solid surface for supporting a processing pad. In this embodiment, the table 114 is a rotating platen that is driven by a drive assembly 118.

The planarizing machine 100 also includes a workpiece carrier assembly 130 that controls and protects a microelectronic workpiece 131 during planarization or electrochemical-mechanical planarization/deposition processes. The carrier assembly 130 can include a workpiece holder 132 to pick up, hold and release the workpiece 131 at appropriate stages of a planarizing cycle and/or a conditioning cycle. The workpiece carrier assembly 130 also generally has a backing member 134 contacting the backside of the workpiece 131 and an actuator assembly 136 coupled to the workpiece holder 132. The actuator assembly 136 can move the workpiece holder 132 vertically (arrow H), rotate the workpiece holder 132 (arrow I), and/or translate the workpiece holder 132 laterally. In a typical operation, the actuator assembly 136 moves the workpiece holder 132 to press the workpiece 131 against a processing pad 140.

The processing pad 140 shown in FIG. 2 has a planarizing medium 142 and a contact surface 144 for selectively removing material from the surface of the workpiece 131. The planarizing medium 142 can have a binder 145 and a plurality of abrasive particles 146 distributed throughout at least a portion of the binder 145. The binder 145 is generally a resin or another suitable material, and the abrasive particles 146 are generally alumina, ceria, titania, silica or other suitable abrasive particles. At least some of the abrasive particles 146 are partially exposed at the contact surface 144 of the processing pad 140. Suitable fixed-abrasive planarizing pads are disclosed in U.S. Pat. Nos. 5,645,471; 5,879,222; 5,624,303; and U.S. patent application Ser. Nos. 09/164,916 and 09/001,333; all of which are herein incorporated by reference. In other embodiments the processing pad 140 can be a non-abrasive pad without abrasive particles, such as a Rodel OXB 3000 "Sycamore" polishing pad manufactured by Rodel Corporation. The Sycamore pad is a hard pad with trenches for macro-scale slurry transportation underneath the workpiece 131. The contact surface 144 can be a flat surface, or it can have a pattern of micro-features, trenches, and/or other features.

Referring still to FIG. 2, the dispenser 160 is configured to discharge the planarizing solution 150 onto a plurality of separate locations of the pad 140. In this embodiment, the dispenser 160 includes a support 162 extending over a portion of the pad 140 and a fluid discharge unit or distributor 164 (shown schematically) carried by the support 162. The support 162 can be an elongated arm that is attached to an actuator 166 that moves the support 162 relative to the pad 140. The distributor 164 can discharge a flow of the planarizing solution 150 onto the contact surface 144 of the pad 140. The distributor 164, for example, can be an elongated slot or a plurality of other openings extending along a bottom portion of the support 162. In this embodiment, the distributor 164 creates an elongated flow of planarizing solution 150 that simultaneously contacts an elongated portion of the contact surface 144 of the pad 140. The dispenser 160 accordingly discharges the planarizing solution onto a plurality of separate points or areas of the contact surface 144.

Figure 3A:
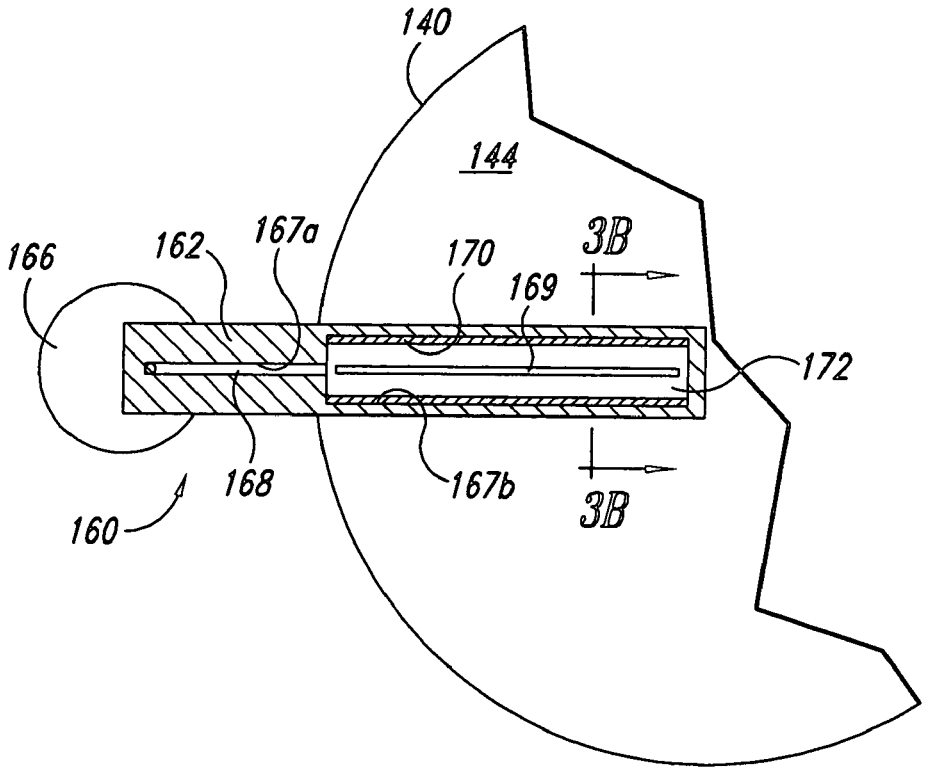
FIGS. 3A–3C are cross-sectional views showing an embodiment of a planarizing solution dispenser in accordance with the invention.

FIG. 3A is a top cross-sectional view showing the embodiment of the dispenser 160 of FIG. 2 along line 3A—3A. In this embodiment, the support 162 has a fluid passageway 168 for receiving the planarizing solution from a reservoir (not shown in FIG. 3A). The fluid passageway 168 can have a proximal section 167*a* through which the planarizing solution flows into the support and a distal section 167*b* defining a cavity over the processing pad 140. The distributor 164 in this embodiment can have an elongated slot 169 along the bottom of the support 162 and a valve 170 within the distal section 167*b* of the fluid passageway 168. The valve 170 has a cavity 172, and the planarizing fluid can flow through the proximal section 167*a* and into the cavity 172 of the valve 170. The valve 170 operates to open and close the elongated slot 169 for controlling the flow of planarizing solution onto the contact surface 144.

Figure 3B:
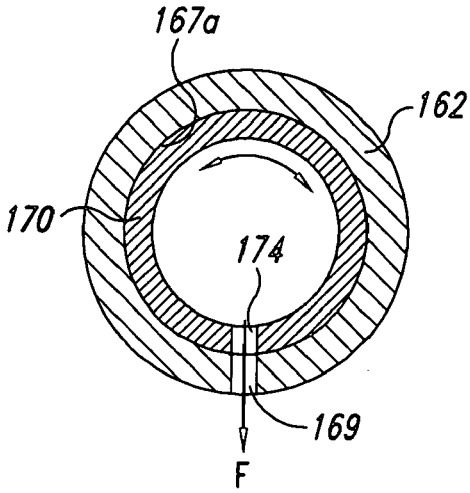
Figure 3C:
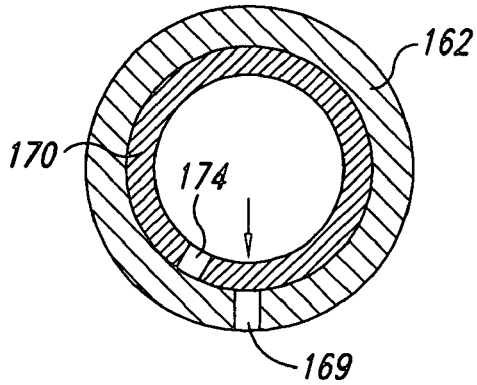

FIGS. 3B and 3C are cross-sectional views of the dispenser 160 taken along line 3B—3B shown in FIG. 3A. Referring to FIG. 3B, the valve 170 can fit within the distal section 167*b* so that an outer wall of the valve 170 engages or otherwise faces an inner wall of the distal section 167*b*. The valve 170 can have an elongated slot 174 or a plurality of holes extending along a portion of the valve. FIG. 3B illustrates the valve 170 in an open position in which the slot 174 in the valve 170 is at least partially aligned with the elongated slot 169 in the support 162 so that a fluid F can flow through the slot 169. FIG. 3C illustrates the valve 170 in a closed position in which the slot 174 is not aligned with the elongated slot 169 so that the valve 170 prevents the planarizing solution from flowing through the distributor 164. In operation, a motor or other actuator (not shown) can rotate the valve 170 within the arm 162 to open and close the slot 169.

Several embodiments of the planarizing machine 100 shown in FIG. 2 are expected to provide better planarizing results because the dispenser 160 is expected to provide a uniform coating of planarizing solution 150 across the contact surface 144 of the pad 140. By discharging the planarizing solution 150 along an elongated line across the pad 140, the planarizing solution 150 is deposited onto a plurality of separate areas of the contact surface 144. As the pad 140 rotates, the centrifugal force drives planarizing solution 150 off the perimeter of the pad. The wide coverage of the discharge area for the planarizing solution 150 and the spinning motion of the pad 140 act together to provide a distribution of planarizing solution across the pad 140 that is expected to have a uniform thickness. As a result, several embodiments of the planarizing machine 100 are expected to provide more uniform pad wear and temperature distribution across the contact surface 144 of the pad 140. Therefore, several embodiments of the planarizing machine 100 are expected to provide consistent planarizing results by reducing variances in planarizing parameters caused by a non-uniform distribution of planarizing solution.

Figure 4:
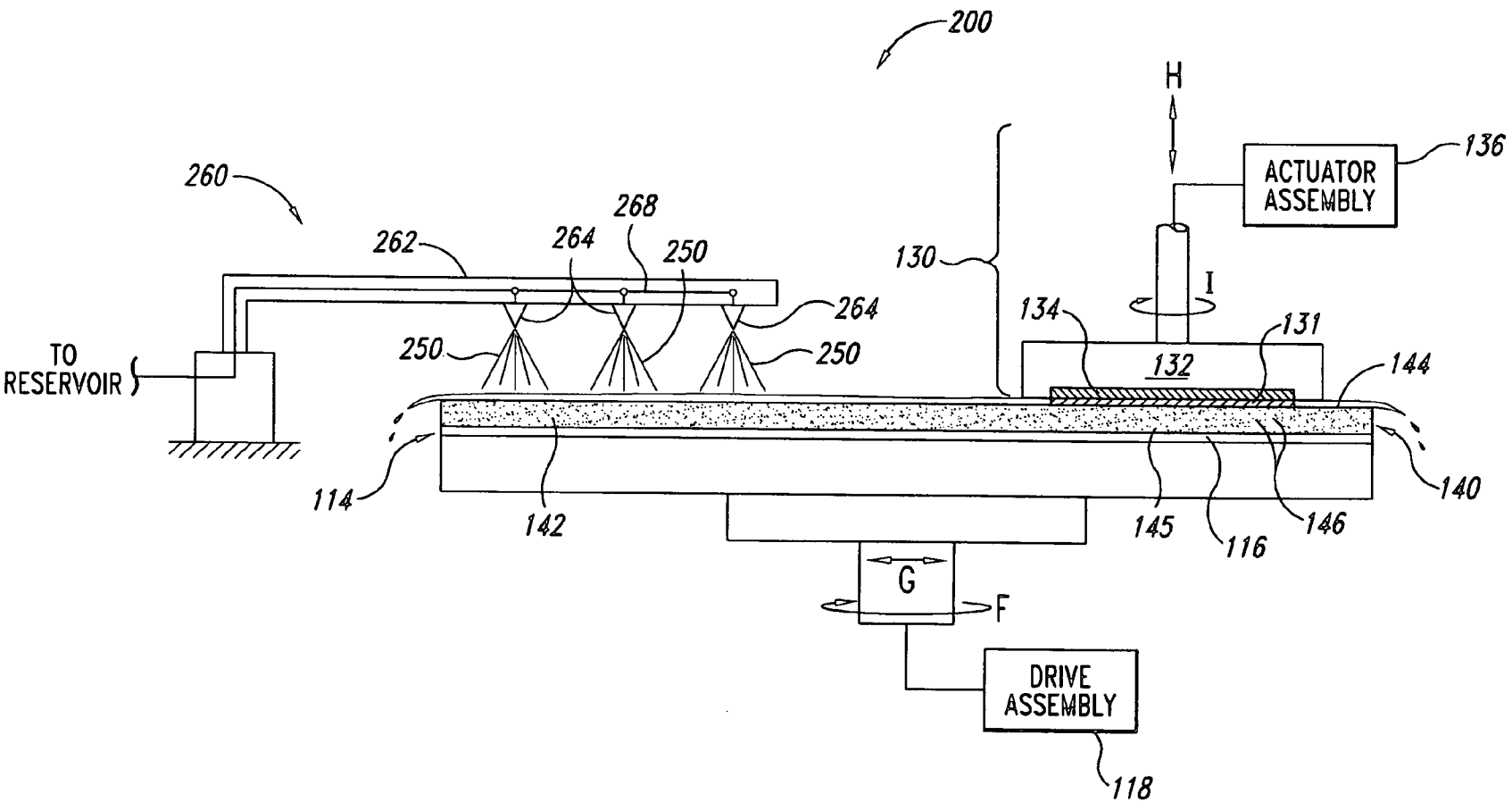
FIG. 4 is a side elevation view of a planarizing system including a planarizing solution dispenser in accordance with another embodiment of the invention with selected components shown in cross-section or schematically.
Figure 5:
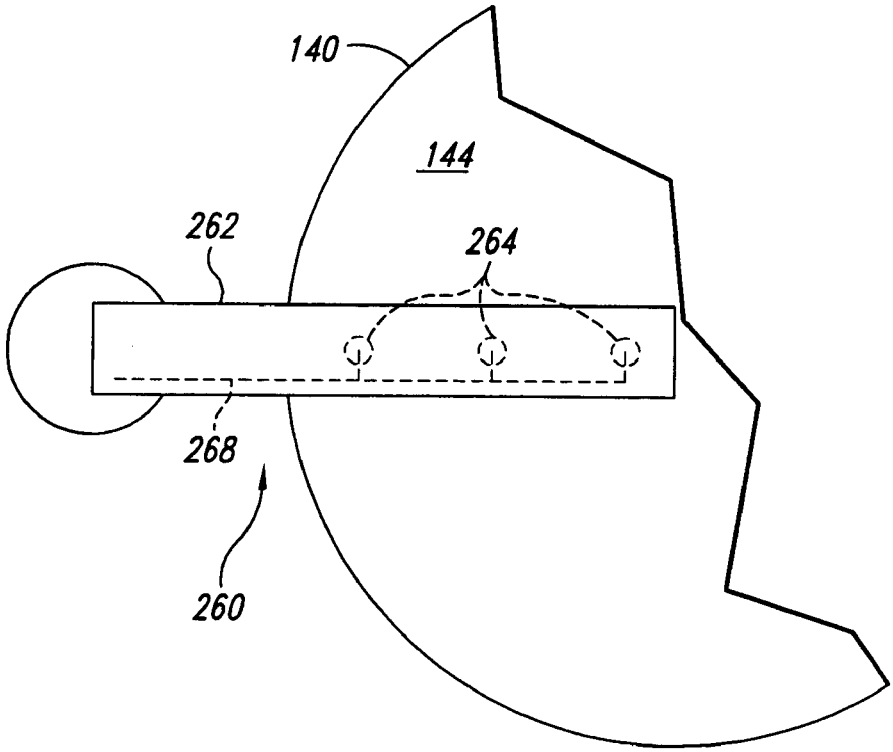
FIG. 5 is a top plan view of the planarizing system of FIG. 4.

FIGS. 4 and 5 illustrate the planarizing machine 200 having a solution dispenser 260 in accordance with another embodiment of the invention. The table 114, the drive assembly 118 and the carrier assembly 130 can be similar to those described above with reference to FIG. 2, and thus like reference numbers refer to like components in FIGS. 2–5. In this embodiment, the dispenser 260 includes a support 262 and a plurality of nozzles 264 carried by the support 262. The nozzles 264 are in fluid communication with a fluid passageway 268 that is also carried by the support 262. The nozzles 264 can be configured to produce gentle, low-velocity flows of planarizing solution 250. In operation, the planarizing solution 250 is pumped through the fluid passageway 268 and through the nozzles 264. The nozzles 264 accordingly define a distributor that discharges the planarizing solution 250 onto a plurality of locations of the pad 140. The planarizing machine 200 is expected to have several of the same advantages as the planarizing machine 100 described above.

Figure 7:
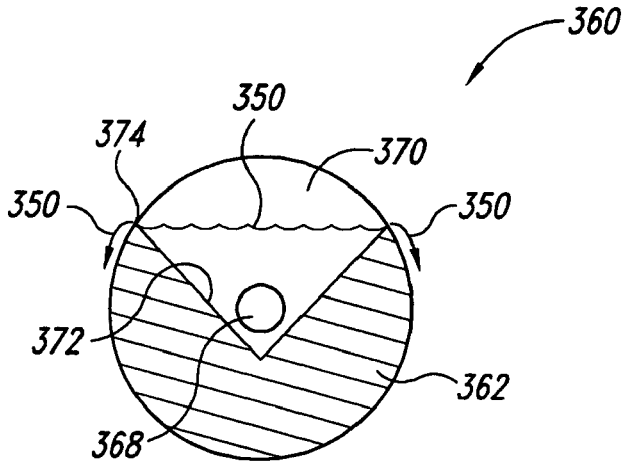
FIG. 7 is a front cross-sectional view of a portion of the planarizing solution dispenser of FIG. 6.
Figure 6:
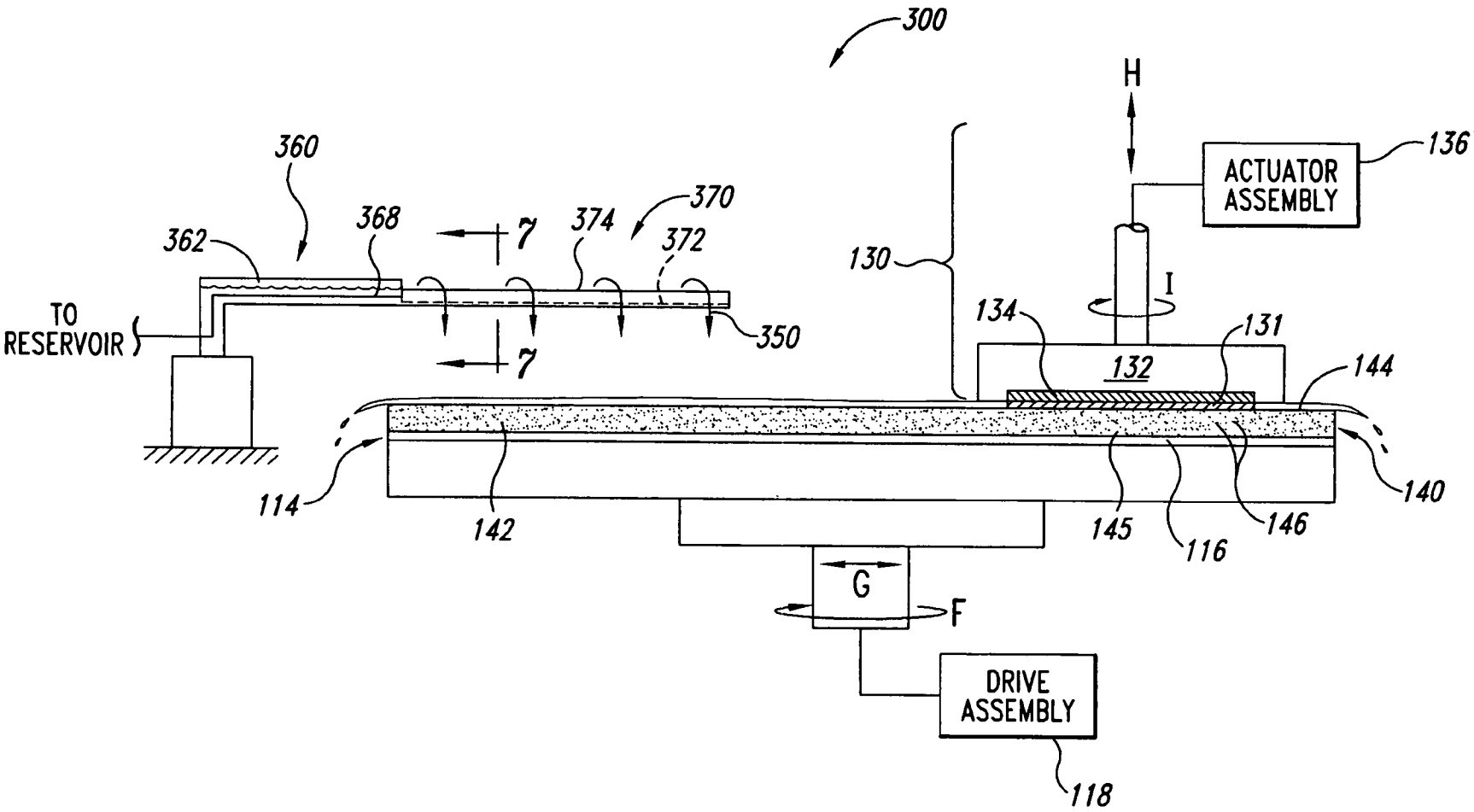
FIG. 6 is a side elevation view of a planarizing system including a planarizing solution dispenser in accordance with an embodiment of the invention with selected components shown in cross-section or schematically.

FIGS. 6 and 7 show a dispenser 360 in accordance with another embodiment of the invention for use with a planarizing machine 300. Referring to FIG. 6, the dispenser 360 has a support 362 with a fluid passageway 368 that extends into a weir 370. FIG. 7 is a cross-sectional view of the support 362 taken along line 7—7 of FIG. 6. Referring to FIG. 7, the weir 370 includes a channel or trough 372 that is in fluid communication with the fluid passageway 368 and a lip 374 at the top of the trough 372. In operation, a planarizing fluid 350 flows through the fluid passageway 368 and fills the trough 372 until the planarizing solution 350 flows over the lip 374. As shown in FIG. 6, the dispenser 360 discharges the planarizing solution 350 onto a plurality of separate locations of the contact surface 144. Several embodiments of the dispenser 360 are expected to operate in a manner similar to the dispensers 160 and 260 explained above.

Figure 8:
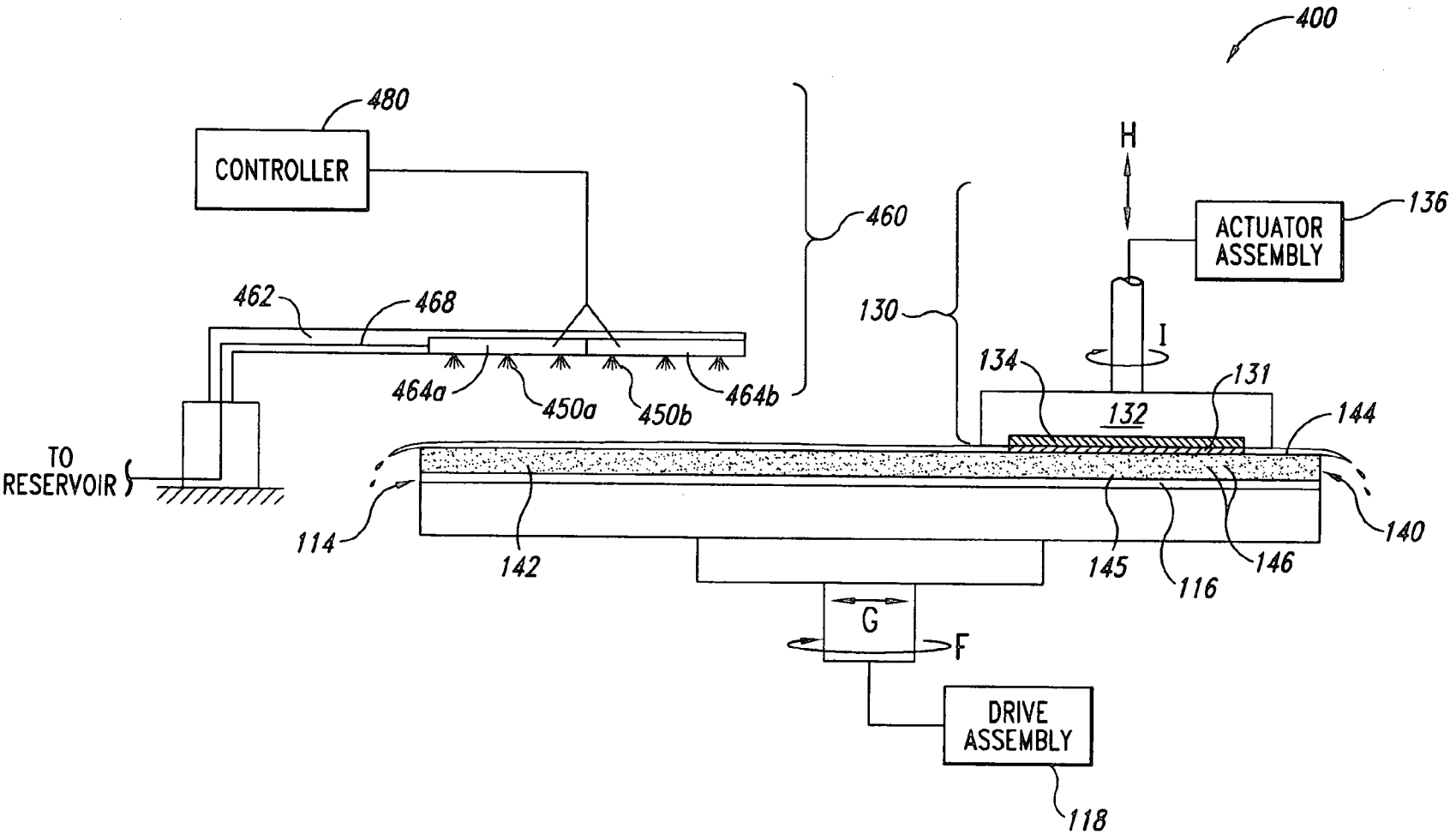
FIG. 8 is a side elevation view of a planarizing system including a planarizing solution dispenser in accordance with an embodiment of the invention with selected components shown in cross-section or schematically.

FIG. 8 shows a planarizing machine 400 having a distributor 460 in accordance with another embodiment of the invention. In this embodiment, the distributor 460 includes a support 462, a first fluid discharge unit 464*a* carried by a first section of the support 462, and a second fluid discharge unit 464*b* carried by a second section of the support 462. The dispenser 460 can further include a fluid passageway 468 coupled to each of the first and second discharge units 464*a* and 464*b*. The dispenser 460 also includes a controller 480 coupled to the fluid passageway 468 and/or each of the first and second fluid discharge units 464*a* and 464*b*.

In operation, the controller 480 independently controls the flow of the planarizing solution to the first and second fluid discharge units 464*a* and 464*b*. The first fluid discharge unit 464*a* can accordingly discharge a first flow of planarizing fluid 450*a*, and the second fluid discharge unit 464*b* can discharge a second flow of planarizing fluid 450*b*. The controller 480 can vary the first and second flows 450*a* and 450*b* of planarizing solution so that the planarizing solution is discharged onto the contact surface 144 in a manner that provides a desired distribution of the planarizing solution across the pad 140. For example, if the temperature at the perimeter portion of the processing pad 140 is greater than the central portion, then the first fluid flow 450*a* can be increased and/or the second fluid flow 450*b* can be decreased so that more planarizing solution is deposited onto the perimeter portion of the processing pad 140 relative to the central portion to dissipate more heat from perimeter portion of the pad 140. The controller 480 can be a computer, and each of the fluid discharge units 464*a* and 464*b* can be separate nozzles, slots, weirs, or other structures that can independently discharge separate fluid flows onto the pad 140.

Several embodiments of the planarizing machine 400 are expected to provide good control of planarizing parameters. By independently discharging separate fluid flows onto the pad 140, the distributor 460 and the controller 480 can be manipulated to change the distribution of the planarizing solution across the surface of the pad according to the actual planarizing results or parameters that are measured during a planarizing cycle. As such, the planarizing machine can create a desired nonuniform distribution of planarizing solution across the pad 140 to compensate for variances in other planarizing parameters. Therefore, several embodiments of the planarizing machine 400 are expected to provide additional control of the planarizing parameters to consistently produce high-quality planarized surfaces.

Figure 9:
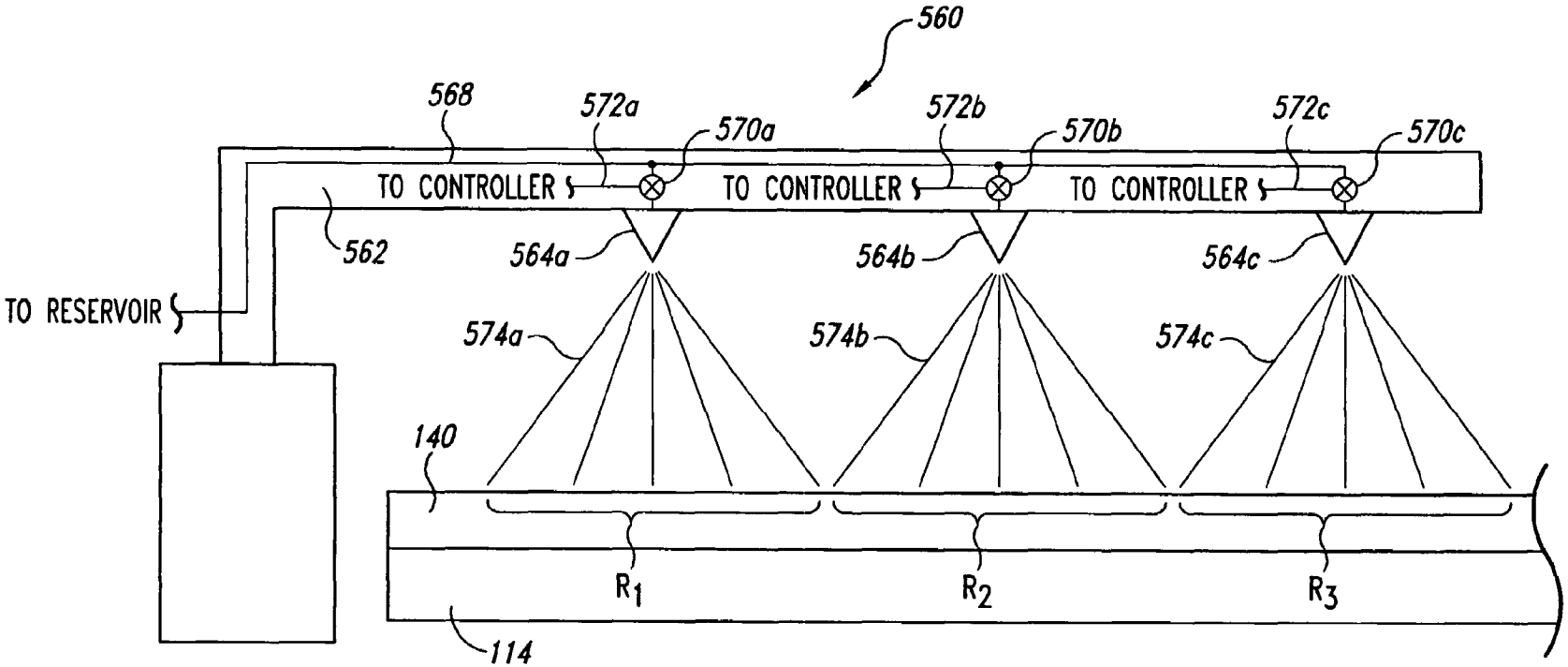
FIG. 9 is a side elevation view of an embodiment of a planarizing solution dispenser in accordance with the embodiment of FIG. 8.

FIG. 9 illustrates a dispenser 560 in accordance with another embodiment of the invention that can be used with the controller 480 of FIG. 8. In this embodiment, the dispenser 560 includes a support 562 extending over the pad 140 and a plurality of nozzles 564 (identified individually be reference numbers 564*a–c*) carried by the support 562. The support 562 can be an arm that is attached to an actuator or a fixed support relative to the pad 140. The nozzles 564 can include at least a first nozzle 564*a* defining a first fluid discharge unit and a second nozzle 564*b* defining a second fluid discharge unit. The nozzles 564 can also include a third nozzle 564*c* defining a third fluid discharge unit or any other suitable number of nozzles. The dispenser 560 also includes a fluid passageway 568 and a plurality of control valves 570 (identified individually by reference numbers 570*a–c*) coupled between the fluid passageway 568 and the nozzles 564. In this embodiment, the control valves include a first control valve 570*a* coupled to the first nozzle 564*a*, a second control valve 570*b* coupled to the second nozzle 564*b*, and a third control valve 570*c* coupled to the third nozzle 564*c*. The control valves 570 can be solenoid valves that are operatively coupled to the controller (not shown in FIG. 9) by signal lines 572*a–c*.

In operation, a planarizing solution flows through the fluid passageway 568 to the control valves 570, and the controller adjusts the control valves 570 to provide a plurality of separate planarizing solution flows 574*a–c* from the nozzles 564*a–c*. The controller can adjust the control valves according to real-time input from sensors during the planarizing cycles of the workpieces and/or from data based upon previous planarizing cycles. This allows the nozzles 564*a–c* to independently discharge the planarizing solution flows 574*a–c* onto separate regions $R_1$–$R_3$ across the pad 140 to compensate for nonuniformities in planarizing parameters across the pad 140. For example, if region $R_1$ requires less planarizing solution than region $R_2$, then the controller can send a signal to the first control valve 570*a* to reduce the first planarizing solution flow 574*a* from the first nozzle 564*a*. This is only an example, and it will be appreciated that many different combinations of flows can be configured by selecting the desired flow rates through the control valves 570.

Figure 10:
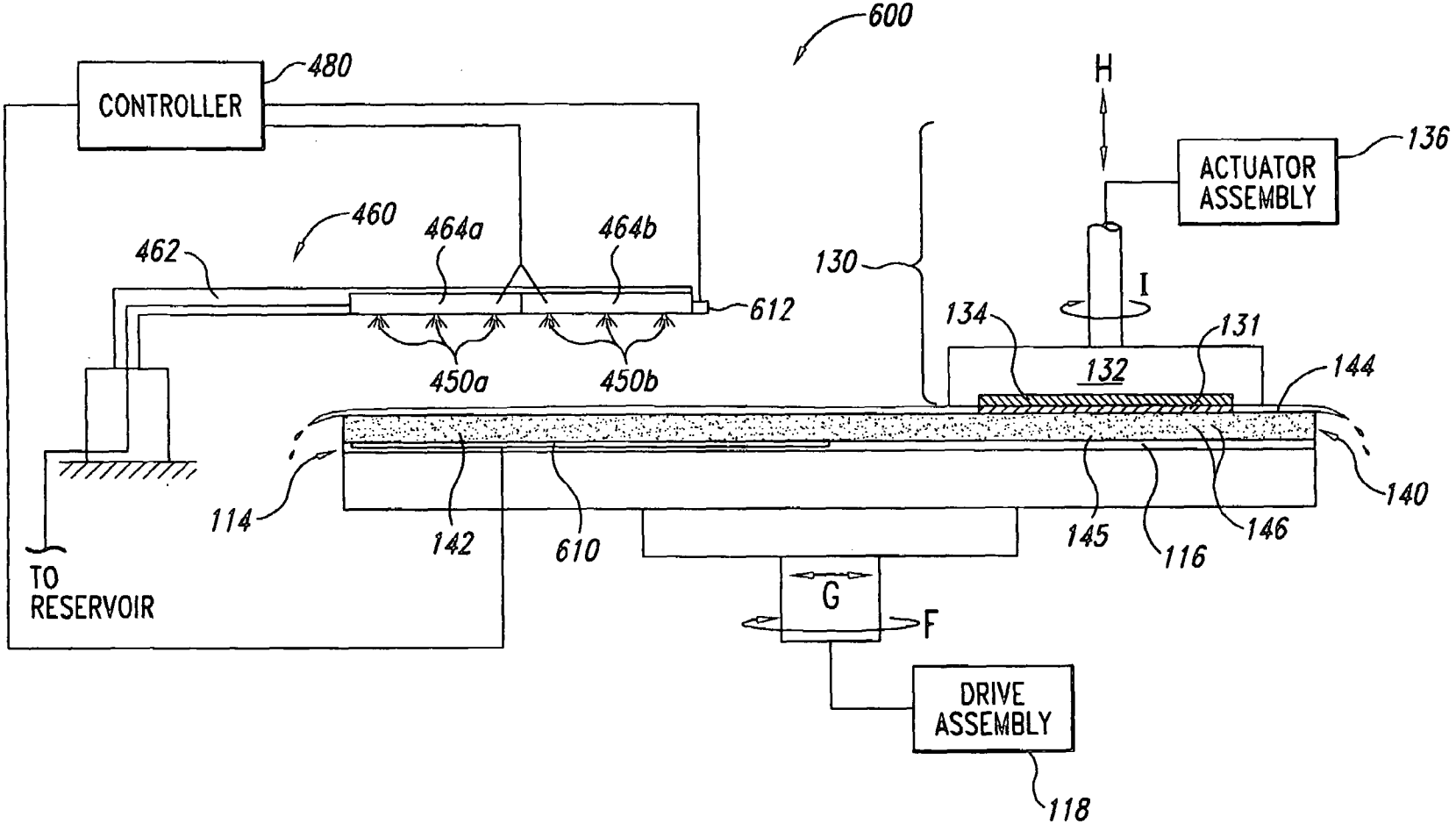
FIG. 10 is a side elevation view of a planarizing system including a planarizing solution dispenser in accordance with an embodiment of the invention with selected components shown in cross-section or schematically.

FIG. 10 shows a planarizing machine 600 in accordance with another embodiment of the invention. The planarizing machine 600 can have several components that are similar to the planarizing machine 400 shown in FIG. 8, and thus like reference numbers refer to like components in FIGS. 8 and 10. Additionally, the dispenser 460 in FIG. 10 can be similar to the dispenser 560 of FIG. 9. The planarizing machine 600 also includes a sensor assembly 610 that senses a planarizing parameter relative to areas or regions on the contact surface 144 of the pad 140. The sensor assembly 610 can be embedded in the pad 140, between the pad 140 and the support surface 116, and/or embedded in the support surface 116 of the table 114. The sensor assembly 610 can include temperature sensors that sense the temperature at the contact surface 144, pressure sensors that sense localized forces exerted against the contact surface 144, and/or drag force sensors between the workpiece 131 and the contact surface 144. Suitable sensor assemblies are disclosed in U.S. patent application Ser. Nos. 6,207,764; 6,046,111; 5,036,015; and 5,069,602; and U.S. patent application Ser. Nos. 09/386,648 and 09/387,309, all of which are herein incorporated by reference. In an alternate embodiment, the sensor assembly can be a sensor 612 positioned above the pad 140. The sensor 612 can be an infrared sensor to measure the temperature gradient across the contact surface, or the sensor 612 can be an optical sensor for sensing another type of parameter. The sensor assembly 610 and the sensor 612 can be coupled to the controller 480 to provide feedback signals of the sensed planarizing parameter.

In the operation of the planarizing machine 600, the sensor assembly 610 senses the planarizing parameter (i.e., temperature, pressure and/or drag force) and sends a corresponding signal to the controller 480. The sensor assembly 610, for example, can sense the differences in the planarizing parameter across the contact surface 144 and send signals to the controller 480 corresponding to a distribution of the planarizing parameter across the contact surface 144. The controller 480 then sends command signals to the fluid discharge units 464*a* and 464*b* according to the sensed planarizing parameters to independently adjust the flow rates of the planarizing solution flows 450*a* and 450*b* in a manner that brings or maintains the planarizing parameter within a desired range.

Figure 11:
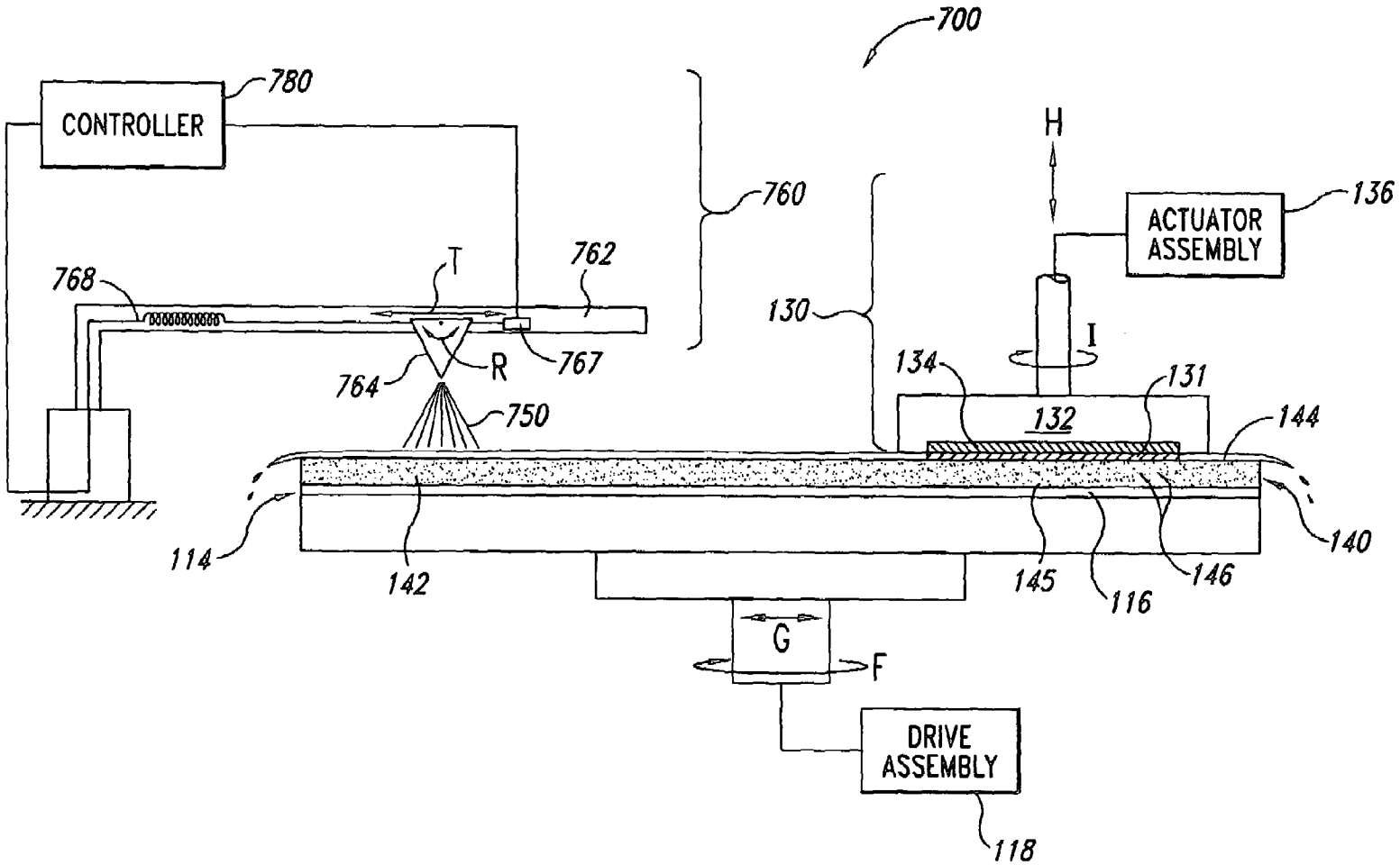
FIG. 11 is a side elevation view of a planarizing system including a planarizing solution dispenser in accordance with an embodiment of the invention with selected components shown in cross-section or schematically.

FIG. 11 shows a planarizing machine 700 having a distributor 760 and a controller 780 coupled to the distributor 760 in accordance with another embodiment of the present invention. In this embodiment, the distributor 760 includes a support 762 and a fluid discharge unit 764 moveably coupled to the support 762. The fluid discharge unit 764 can be slidably coupled to the support 762 to translate along the length of the support 762 (indicated by arrow T). In an alternate embodiment, the fluid discharge unit 764 can be rotatably carried by the support 762 (arrow R). The dispenser 760 can further include an actuator 767 coupled to the fluid discharge unit 764, and the support 762 can be a track along which the fluid discharge unit 764 can translate. The actuator 767 can be a servomotor or a linear actuator that drives the fluid discharge unit 764 along the support 762. The actuator 767 can also rotate the fluid discharge unit 764 relative to the support 762 in lieu of, or in addition to, translating the fluid discharge unit 764 along the support 762. The dispenser 760 can also include a fluid passageway 768 coupled to the fluid discharge unit 764. The fluid passageway 768 can be a flexible hose that coils up or elongates according to the movement of the fluid discharge unit 764 along the support 762.

The controller 780 is coupled to the actuator 767 to control the motion of the fluid discharge unit 764 relative to the support 762. The controller 780 can send command signals to the actuator 767 to increase or decrease the velocity of the relative motion between the fluid discharge unit 764 and the arm 762 to adjust the volume of planarizing solution deposited onto different areas of the contact surface 144 of the pad 140. This embodiment allows a single flow of planarizing solution 750 to have different flow characteristics according to the desired distribution of planarizing solution across the contact surface 144.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

The invention claimed is:

1. A planarizing machine, comprising:

a table having a support surface;

a processing pad on the support surface;

a carrier assembly having a head configured to hold a microelectronic workpiece and a drive assembly carrying the head relative to the support surface;

a solution dispenser separate from the head, the solution dispenser being configured to discharge a planarizing solution onto a plurality of locations on the pad, wherein the solution dispenser comprises an elongated support over the pad at a location spaced apart from a travel path of the head, a fluid passageway carried by the support through which a planarizing solution can flow, and an elongated distributor slot along at least a portion of the support; and a valve having an elongated valve slot movable between an open position and a closed position, in the open position the valve slot being aligned with the distributor slot so that the distributor slot is in fluid communication with the fluid passageway to create an elongated flow of planarizing solution and in the closed position the valve slot being positioned away from the distributor slot so that planarizing solution cannot flow through the distributor slot.

2. A planarizing machine, comprising:

a table having a support surface;

a processing pad on the support surface;

a carrier assembly having a head configured to hold a microelectronic workpiece and a drive assembly carrying the head relative to the support surface; and a solution dispenser separate from the head, the solution dispenser being configured to discharge a planarizing solution onto a plurality of locations on the pad, wherein the solution dispenser comprises an elongated support over the pad at a location spaced apart from a travel path of the head, a channel along at least a portion of the support through which a planarizing solution can flow, the channel having an elongated opening with a lip along at least a portion of the elongated opening, the lip being configured so that planarizing solution being discharged from the solution dispenser can flow over the lip.

3. A planarizing machine, comprising:

a table having a support surface;

a processing pad on the support surface;

a carrier assembly having a head configured to hold a microelectronic workpiece and a drive assembly carrying the head;

a solution dispenser separate from the head, the solution dispenser having a support over the pad and a distributor carried by the support, the distributor being configured to discharge a planarizing solution from a plurality of locations along the support, wherein the support comprises an elongated arm and a fluid passageway carried by the arm through which a planarizing solution can flow, and the distributor further comprises an elongated slot along at least a portion of the arm; and a valve having an elongated valve slot movable between an open position and a closed position, in the open position the valve slot being aligned with the distributor slot so that the distributor slot is in fluid communication with the fluid passageway to create an elongated flow of planarizing solution and in the closed position the valve slot being positioned away from the distributor slot so that planarizing solution cannot flow through the distributor slot.

4. A planarizing machine, comprising:

a table having a support surface;

a processing pad on the support surface;

a carrier assembly having a head configured to hold a microelectronic workpiece and a drive assembly carrying the head; and a solution dispenser separate from the head, the solution dispenser having a support over the pad and a distributor carried by the support, the distributor being configured to discharge a planarizing solution from a plurality of locations along the support wherein the support comprises an elongated arm and a channel along at least a portion of the arm through which a planarizing solution can flow, and the distributor further comprises a weir along at least a portion of the channel over which the planarizing solution can flow.

5. A planarizing machine, comprising:

a table having a support surface;

a processing pad on the support surface;

a carrier assembly having a head configured to hold a microelectronic workpiece and a drive assembly carrying the head;

a solution dispenser having an elongated opening along the fluid conduit through which a planarizing solution can flow; and a valve having an elongated valve opening movable between an open position and a closed position, in the open position the valve opening being aligned with the distributor opening so that planarizing solution can flow through the distributor opening and in the closed position the valve opening being positioned away from the distributor opening so that planarizing solution cannot flow through the distributor opening.

6. A planarizing machine, comprising:

a table having a support surface;

a processing pad on the support surface;

a carrier assembly having a head configured to hold a microelectronic workpiece and a drive assembly carrying the head; and a solution dispenser having an elongated weir over which a planarizing solution can flow, the weir being spaced apart from the processing pad and positioned over at least a portion of the processing pad.

7. A method of processing a microelectronic workpiece, comprising:

removing material from the workpiece by pressing the workpiece against a contact surface of a processing pad and imparting relative motion between the workpiece and the contact surface;

depositing a first flow of a planarizing solution from a dispenser directly onto a first region of the contact surface; and depositing a second flow of the planarizing solution from the dispenser directly onto a second region of the contact surface separate from the first region, wherein the dispenser comprises a support, a first elongated slot along a first section of the support, and a second elongated slot along a second section of the support, and depositing the flow of the planarizing solution comprises discharging planarizing solution through the first and second slots at a common flow rate, the first slot discharging the first flow and the second slot discharging the second flow.

8. A method of processing a microelectronic workpiece, comprising:

removing material from the workpiece by pressing the workpiece against a contact surface of a processing pad and imparting relative motion between the workpiece and the contact surface; and moving an elongated valve slot from a closed position to an open position, in the open position the valve slot being aligned with an elongated distributor slot of a dispenser having a support so that a planarizing solution is discharged directly onto a first region of the contact surface and concurrently discharged onto a second region of the contact surface separate from the first region, the planarizing solution being deposited onto the first and second regions separate from a head carrying the workpiece, in the closed position the valve slot being positioned away from the distributor slot so that planarizing solution cannot flow through the distributor slot.

9. A method of processing a microelectronic workpiece, comprising:

removing material from the workpiece by pressing the workpiece against a contact surface of a processing pad and imparting relative motion between the workpiece and the contact surface; and discharging a planarizing solution directly onto a first region of the contact surface and concurrently discharging the planarizing solution directly onto a second region of the contact surface separate from the first region, the planarizing solution being deposited onto the first and second regions separate from a head carrying the workpiece, wherein the planarizing solution is discharged through a dispenser having a support and an elongated weir along at least a portion of the support, and discharging the planarizing solution onto the pad comprises passing a flow of planarizing solution over the weir.

10. A planarizing machine, comprising:

a table having a support surface;

a processing pad on the support surface;

a carrier assembly having a head configured to hold a microelectronic workpiece and a drive assembly carrying the head relative to the support surface;

a solution dispenser separate from the head, the solution dispenser including an elongated support over the pad, a fluid passageway carried by the support, and an elongated element along at least a portion of the support, the elongated element having an elongated distributor slot positioned along a longitudinal dimension of the support; and a valve having an elongated valve slot movable between an open position and a closed position, in the open position the valve slot being aligned with the distributor slot so that the distributor slot is in fluid communication with the fluid passageway to create a flow of planarizing solution elongated along the longitudinal dimension of the support and in the closed position the valve slot being positioned away from the distributor slot so that planarizing solution cannot flow through the distributor slot.

11. A planarizing machine, comprising:

a table having a support surface;

a processing pad on the support surface;

a carrier assembly having a head configured to hold a microelectronic workpiece and a drive assembly carrying the head relative to the support surface; and a solution dispenser separate from the head, the solution dispenser including an elongated support over the pad, a fluid passageway carried by the support, and an elongated element along at least a portion of the support, the elongated element being in fluid communication with the fluid passageway and configured to create a flow of planarizing solution elongated along a longitudinal dimension of the support, the elongated element comprising a weir having an elongated lip over which the planarizing solution can flow.

12. The planarizing machine of claim 1 wherein the elongated distributor slot is elongated along a first axis, the elongated valve slot is elongated along a second axis at least approximately parallel to the first axis, and the elongated flow of planarizing solution includes an elongated flow of planarizing solution being discharged through the valve slot and the distributor slot onto the pad along a line across the pad.

13. The planarizing machine of claim 2 wherein the elongated opening is elongated along an axis and the planarizing solution that flows over the lip includes an elongated flow of planarizing solution being discharged onto the pad along a line across the pad.

14. The planarizing machine of claim 3 wherein the elongated distributor slot is elongated along a first axis, the elongated valve slot is elongated along a second axis at least approximately parallel to the first axis, and the elongated flow of planarizing solution includes an elongated flow of planarizing solution being discharged through the valve slot and the distributor slot onto the pad along a line across the pad.

15. The planarizing machine of claim 5 wherein the elongated distributor opening is elongated along a first axis, the elongated valve opening is elongated along a second axis at least approximately parallel to the first axis, and the planarizing solution that flows through the distributor opening includes an elongated flow of planarizing solution being discharged through the valve opening and the distributor opening onto the pad along a line across the pad.

16. The method of claim 7 wherein the first elongated slot is elongated along a first axis, the second elongated slot is elongated along a second axis, the first flow includes a first elongated flow of planarizing solution being discharged onto the first region along a first line across the pad, and the second flow includes a second elongated flow of planarizing solution being discharged onto the second region along a second line across the contact surface.

17. The method of claim 16 wherein the first axis is different from the second axis and the first line is different from the second line.

18. The planarizing machine of claim 8 wherein the elongated valve slot is elongated along a first axis, the distributor slot includes an elongated distributor slot elongated along a second axis at least approximately parallel to the first axis, and the planarizing solution being discharged directly onto the first region includes an elongated flow of planarizing solution being discharged through the valve slot and the distributor slot directly onto the first region along a line across the contact surface.

19. The planarizing machine of claim 10 wherein the elongated flow of planarizing solution includes an elongated flow of planarizing solution being discharged through the valve slot and the distributor slot onto the pad along a line across the pad.

* * * * *